US006081952A

United States Patent [19]

Haxton

[11] Patent Number: 6,081,952

[45] Date of Patent: Jul. 4, 2000

[54] ELECTRICAL T FASTENER PLIERS AND METHOD

[76] Inventor: Michael L. Haxton, 65 County Rd. 208, Cameron, Tex. 76520

[21] Appl. No.: 08/885,678

[22] Filed: Jun. 30, 1997

[51] Int. Cl.[7] ..... B25F 1/00; B25B 7/02

[52] U.S. Cl. ..... 7/107; 7/130; 81/426.5; 81/427.5

[58] Field of Search ..... 7/107, 125, 130, 7/133; 81/417, 418, 424.5, 426.5, 427.5, 427

[56] References Cited

U.S. PATENT DOCUMENTS

| | | | |
|---|---|---|---|
| 272,573 | 2/1883 | Mihan | 7/133 |
| 1,176,604 | 3/1916 | Sanders | 81/426.5 |
| 1,453,854 | 5/1923 | Parker | 81/427.5 |
| 2,934,983 | 5/1960 | Daggitt | 81/426.5 |
| 2,951,259 | 9/1960 | Brockner | 81/427.5 |
| 3,120,773 | 2/1964 | Esser | 7/107 |
| 3,525,107 | 8/1970 | Hays | 7/107 |
| 4,028,756 | 6/1977 | Couto . | |
| 4,104,752 | 8/1978 | Amrein et al. | 7/133 |
| 4,337,542 | 7/1982 | Theiler, Sr. | 7/107 |
| 4,407,174 | 10/1983 | Schulze . | |
| 4,625,596 | 12/1986 | Makus . | |
| 4,815,210 | 3/1989 | Burrage | 7/133 |
| 4,934,222 | 6/1990 | Rittmann et al. | 81/427.5 |
| 5,323,502 | 6/1994 | Miller | 7/107 |
| 5,575,029 | 11/1996 | Simpson | 7/107 |
| 5,604,947 | 2/1997 | Bates et al. . | |
| 5,732,461 | 3/1998 | Keffeler et al. | 7/107 |

*Primary Examiner*—David A. Scherbel
*Assistant Examiner*—Joni B. Danganan
*Attorney, Agent, or Firm*—Derek R. Van Gilder

[57] ABSTRACT

An electrical T-fastener pliers has jaws (1, 3) with grip bays (8, 9, 39, 40) that are positioned on T-joint fastener jaws (15, 16, 17, 18) to be clamped onto targeted wires (19) by hand-squeezing handles (2, 4) of the electrical pliers. Jaws of the T-joint fasteners (12) are pressured against jaws of the pliers by outward pressure of outwardly sprung T-joint fasteners against designedly opened pliers jaws or optionally by inward pressure of the pliers jaws against jaws of unsprung T-joint fasteners (13). This provides a spring-pressured containment of a T-joint fastener while the pliers are being positioned in T-joining relationship to targeted electrical wiring. The handles can be extended at angles from the jaws to position a bottom handle designedly removed from a working surface in order to provide finger space between a working surface and in order to facilitate positioning the jaws under wires in close proximity to surfaces. Select wire-processor tooling such as wire strippers (27, 28, 33, 34), crimpers (31, 32) and wire cutters (29, 30) is provided on the jaws and on the handles for particular use conditions.

4 Claims, 2 Drawing Sheets

FIG. 1
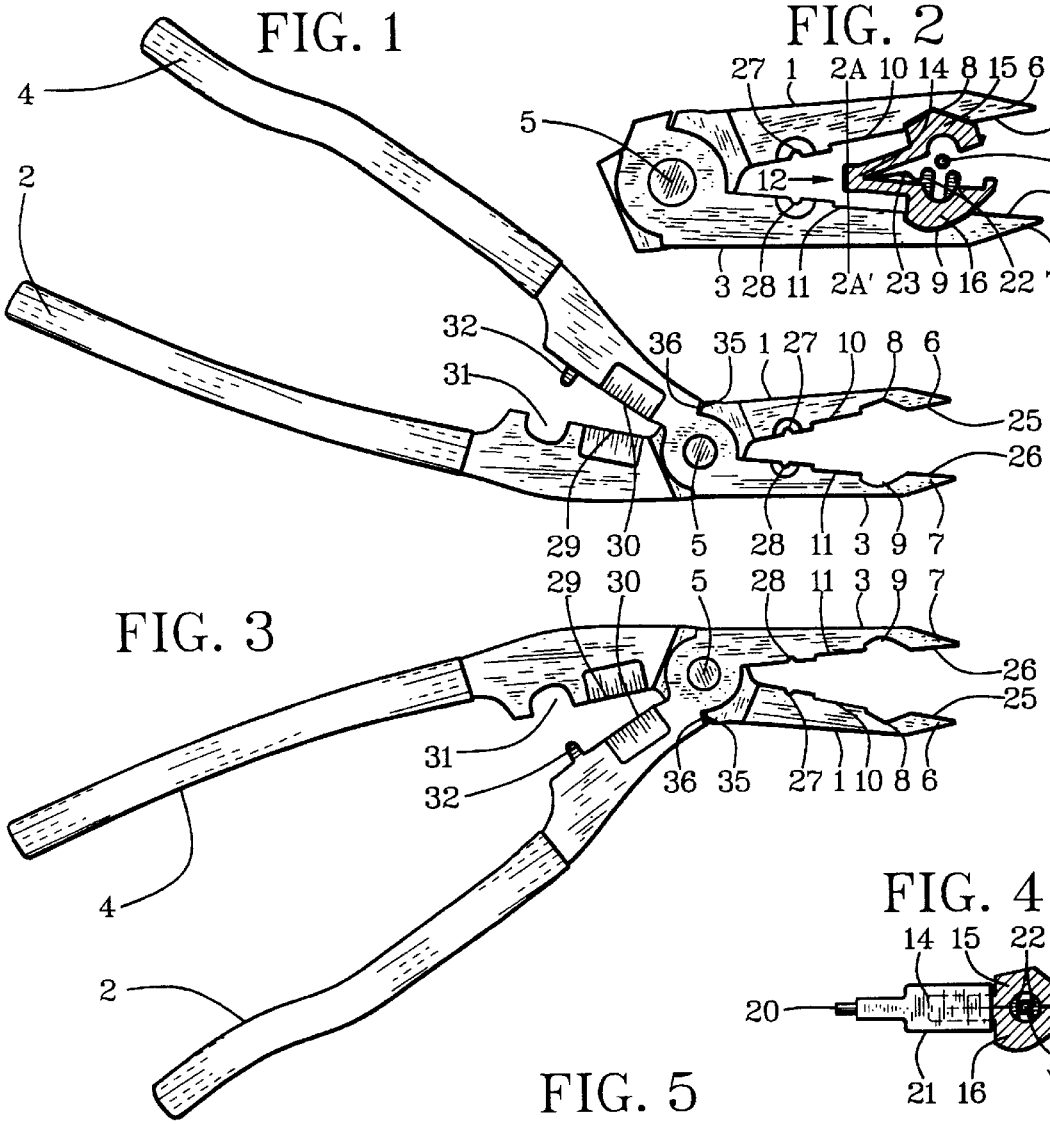
FIG. 2
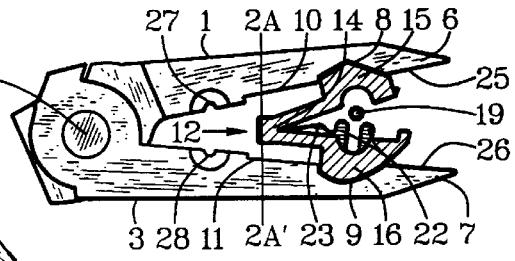
FIG. 3
FIG. 4
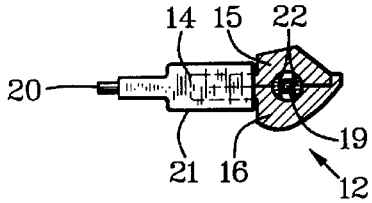
FIG. 5
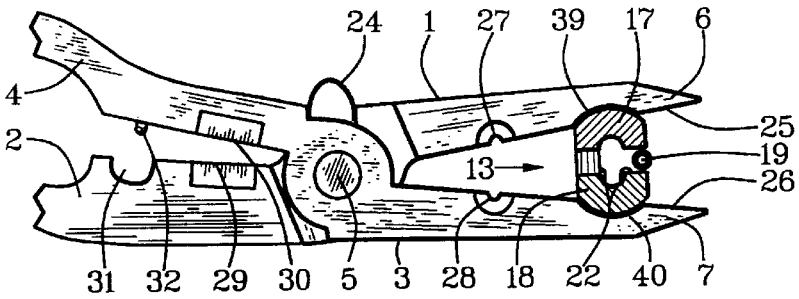
FIG. 6
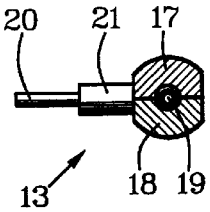

ELECTRICAL T FASTENER PLIERS AND METHOD

BACKGROUND OF THE INVENTION

1. Field of the Invention

This invention relates to hand-tool pliers and in particular to electrical pliers with which electrical-wire T-joint fasteners can be spring-pressure held without being dropped while being positioned and clamped onto targeted electrical wires.

2. Relation To Prior Art

Currently, there are no known electrical pliers having a T-joint closer with which electrical-wire T-joint fastener jaws can be held, positioned and clamped conveniently and efficiently onto targeted electrical wires in a manner taught by this invention. Conventionally, T-joint fasteners are hand-held and either hand-clamped or pressured together with variously inconvenient, awkward and ineffective means.

Examples of different but related electrical pliers without T-joint closers are described in the following patent documents. U.S. Pat. No. 5,604,947, issued to Bates et al, described pliers that gripped and cut wire. U.S. Pat. No. 4,407,174, issued to Schulze, described wire-stripping pliers with adjustable lock jaws. U.S. Pat. No. 4,625,596, issued to Makus, taught electrical pliers that simultaneously cut and stripped lengths of insulation from electrical wire. U.S. Pat. No. 4,028,756, issued to Couto, taught electrical pliers having a graduated set of crimping nests that were close together in order to be near a plier axle.

Examples of different but related general-purpose pliers include U.S. Pat. No. 5,347,670, issued to Duguette et al, which taught a lock-grip pliers with a wire-cutting feature. U.S. Pat. No. 4,735,117, issued to Ducret, taught wire cutters with stripping and cutting features. U.S. Pat. No. 4,080,733, issued to Clegg, taught linesmen pliers having disc cutters. U.S. Pat. No. 4,009,514, issued to Couto, taught pliers with a variety of shapes and sizes of crimpers.

Prior art does not address nor solve an increasingly common problem of crimp-fastening T joints of electrical wires effectively and efficiently as taught by this invention.

SUMMARY OF THE INVENTION

In light of need for improvement of electrical pliers in relation to T-joint fasteners, objects of this invention are to provide electrical T-fastener pliers which:

- can clamp T-joint fasteners of electrical wire for reliable conductive connections;
- holds T-joint fasteners snugly without hand-grip of the pliers while being positioned onto wires that are difficult to access between or close to adjacent electrical components, other wires and/or container surfaces;
- is angle-shaped to make T connections in close proximity to attachment surfaces;
- has a design selection of related wire-processor tooling;
- has insulated handles; and
- is slim for entry into tight places.

This invention accomplishes these and other objectives with electrical T-fastener pliers having jaws with grip bays that are positioned on T-joint fastener jaws to be clamped onto targeted wires by hand-squeezing handles of the electrical pliers. Jaws of the T-joint fasteners are pressured against jaws of the pliers by outward pressure of outwardly sprung T-joint fasteners against designedly opened pliers jaws or optionally by inward pressure of the pliers jaws against jaws of unsprung T-joint fasteners. This provides a spring-pressured containment of a T-joint fastener while the pliers are being positioned in T-joining relationship to targeted electrical wiring. A nose of the pliers is sized and shaped with width, length and thickness for particular use conditions. The handles can be extended at angles from the jaws to position a bottom handle designedly removed from a working surface in order to provide finger space between a working surface and to facilitate positioning the jaws under wires in close proximity to surfaces. Select wire-processor tooling such as wire strippers, crimpers and wire cutters is provided on the jaws and on the handles for particular use conditions. The handles are preferably insulated and can have finger containers for hand operation in opposition to sprung pliers jaws that hold unsprung T-joint fasteners or optionally sprung T-joint fasteners in a manner that prevents them from being dropped while T-joint fasteners are being positioned for clamping onto targeted wires by the pliers.

BRIEF DESCRIPTION OF DRAWINGS

This invention is described by appended claims in relation to description of a preferred embodiment with reference to the following drawings which are described briefly as follows:

FIG. 1 is a right-side elevation view of an embodiment having a preferred mix of wire processors and positioned for top-surface use;

FIG. 2 is an enlarged fragmentary view of a spring-opened T-joint fastener in jaws of the FIG. 1 illustration;

FIG. 3 is a left-side elevation view of the FIG. 1 illustration positioned for bottom-surface use;

FIG. 4 is a side view of the FIG. 2 T-joint fastener in clamped mode on a targeted wire and having a connector wire attached;

FIG. 5 is an enlarged fragmentary view of an unsprung T-joint fastener in sprung jaws;

FIG. 6 is a side view of a T-joint fastener without a jaw hinge in a clamped mode on a targeted wire and having a connector wire attached.

DESCRIPTION OF PREFERRED EMBODIMENT

Figure 7:
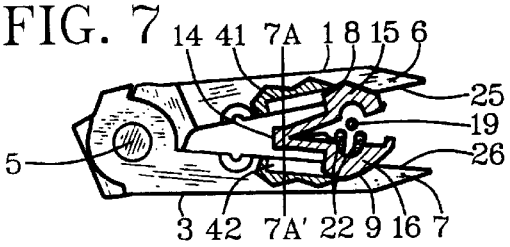
FIG. 7 is an enlarged fragmentary view of a spring-opened T-joint fastener pliers having fastener-jaw slots in which jaws of T-SNAP® fasteners can be contained while being fastened.

Reference is made first to FIGS. 1–6. A first jaw 1 and a first handle 2 are joined pivotally to a second jaw 3 and a second handle 4 with a pliers axle 5 at a pliers fulcrum axis. The first handle 2 and the second handle 4 are insulated. A first-jaw nose 6 is extended from the first jaw 1 and a second-jaw nose 7 is extended from the second jaw 3 at a nose of the pliers.

A T-fastener closer is positioned intermediate the pliers axle 5 and the nose of the pliers. A preferred embodiment of a T-fastener closer has a first grip bay 8 extended from an inside edge of the first jaw 1 and a second grip bay 9 extended from an inside edge of the second jaw 3. The first grip bay 8 and the second grip bay 9 are at designedly equal distances from the pliers axle 5 at positions intermediate a fulcrum axis and a nose of the pliers.

A first fastener-hinge notch 10 can be extended from an axle side of the first grip bay 8 and a second fastener-hinge notch 11 can be extended similarly from an axle side of the second grip bay 9.

The first grip bay 8 is sized and shaped to receive a first side of a T-joint fastener and the second grip bay 9 is sized and shaped to receive a second side of a T-joint fastener. The T-joint fastener can be either a spring-opened T-joint fastener 12 such as depicted in FIGS. 2 and 4 or an unsprung T-joint fastener 13 such as depicted in FIGS. 5–6.

The spring-opened T-joint fastener 12 illustrated in FIGS. 2 and 4 is a representation of a conventional T-SNAP® fastener having a spring-expansion joint 14 between a first sprung fastener jaw 15 and a second sprung fastener jaw 16.

Depths of the first fastener-hinge notch 10 and the second fastener-hinge notch 11 can be structured to accommodate thicknesses of spring-opened T-joint fasteners 12 that are closed in proportion to thicknesses of spring-expansion joints 14. Relatively thick spring-opened T-joint fasteners 12 with comparatively thin spring-expansion joints 14 will need shallow, if any, fastener-hinge notches 10 and 11.

The unsprung T-joint fastener 13 illustrated in FIGS. 5–6 is a representation of a type of T-joint fastener having a first unsprung fastener jaw 17 in unsprung communication with a second unsprung fastener jaw 18. Irrelevant details of the spring-opened T-joint fastener 12 and the unsprung T-joint fastener 13 are not disclosed in this document.

The spring-opened T-joint fastener 12 or the unsprung T-joint fastener 13 are pressured between the first grip bay 8 and the second grip bay 9 by spring pressure to hold either while being positioned on a wire 19 that is targeted for attachment of either respectively. Like holding a magnetically metallic fastener with a magnetic screwdriver or wrench, spring-pressure holding of nonmagnetically plastic T-joint fasteners by an electrical T-fastener pliers allows positioning of either a spring-opened T-joint fastener 12 or an unsprung T-joint fastener 13 without being dropped out of the electrical T-fastener pliers while being maneuvered to and clamped onto a targeted wire 19. A user need not hand-squeeze or very carefully hold handles 2 and 4 while jaws 1 and 3 containing a T-joint fastener 12 or 13 are being positioned in relatively tight positions, distant positions, non-visible positions, close under-wall positions, close over-wall positions, difficult side positions, or other working positions of targeted wires 19.

After a T-joint fastener 12 or 13 so contained in an electrical T-fastener pliers is positioned on a targeted wire 19, the T-joint fastener 12 or 13 is then clamped onto the targeted wire 19 by hand-squeezing the handles 2 and 4. After T-fastening onto a targeted wire 19, hand-squeezing is appropriately relaxed or terminated and the electrical T-fastener pliers is removed.

A connecting wire 20 then can be plugged into or variously connected to the T-joint fastener 12 or 13 with a matching connector such as a plug-in means 21, details of which are not described completely in this document. Basically, clamping of the T-joint fastener 12 or 13 onto a targeted wire 19 forces conductor jaws 22 through insulation that may be on the targeted wire 19 and positions the conductor jaws 22 in reliable electrical contact with the targeted wire 19. An outlet conductor 23 illustrated in FIG. 2 then can be employed to conduct current from the conductor jaws 22 to a connecting wire 20 with particular types of plug-in means 21.

The spring-opened T-joint fastener 12 can be either pivotal with a structure as depicted in FIGS. 2 and 4 or variously non-pivotal or sliding with a structure as depicted in FIGS. 5–6. Likewise, the unsprung T-joint fastener 13 can be either pivotal with a structure as depicted in FIGS. 2 and 4 or variously non-pivotal or sliding with a structure as depicted in FIGS. 5–6.

Spring pressure for containment of an unsprung T-joint fastener 13 can be provided by a containment spring 24 positioned proximate a pliers fulcrum axis as illustrated in FIG. 5. Either an unsprung T-joint fastener 13 or a spring-opened T-joint fastener 12 can be spring-held with the containment spring 24. A simple V-shaped containment spring 24 with expansion pressure directed intermediate the first jaw 1 and the second jaw 3 is depicted for demonstration. In practice, the containment spring 24 of choice would be a coil spring with torsion pressure directed towards a closed mode of the jaws 1 and 3.

Utility of this electrical T-fastener pliers is enhanced by inclusion of work-related wire processors. One wire processor can be a wire grasper comprised of a first wire-grasping surface 25 intermediate the first-jaw nose 6 and the first grip bay 8 on the first jaw 1 in combination with a second wire-grasping surface 26 intermediate the secondjaw nose 7 and the second grip bay 9 on the second jaw 3. The wire grasper can be relatively long or short, depending on design preferences for particular use conditions.

At least one wire processor intermediate the pliers axle 5 and the grip bays 8 and 9 of the T-fastener closer can include a wire stripper having a first wire-stripping bay 27 in the first jaw 1 and a second wire-stripping bay 28 in the second jaw 3.

A wire processor on a handle side of the pliers axle 5 can include a wire cutter having a first wire-cutting blade 29 on the first handle 2 and a second wire-cutting blade 30 on the second handle 4 of the electrical T-fastener pliers. Also included on the handle side of the pliers axle 5 can be a wire-connector crimper having a wire-connector bay 31 in an inward edge of a first handle 2 and a crimping boss 32 extended from an inward edge of a second handle 4 of the electrical T-fastener pliers. The crimping boss 32 is sized and shaped to enter the wire-connector bay 31 in order to crimp a wire connector positioned in the wire-connector bay 31. The wire connector is not described or illustrated in this document.

The first handle 2 and the second handle 4 are preferably extended from the first jaw 1 and from the second jaw 3 respectively at angles. The angles are such that the first handle 2 is to allow fingers of a user to fit intermediate the first handle 2 and a plane that is parallel to an outside edge of the second jaw 3. This preferred angling of the handles 2 and 4 allows positioning of T-joint fasteners 12 and 13 in a wide variety of positions that are otherwise difficult to access.

Figure 8:
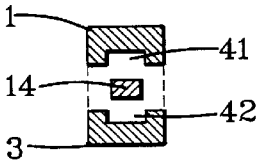
FIG. 8 is a cross-sectional view through cross-sectional line 7A–7A' in FIG. 7 to illustrate a hinge of a T-SNAP® intermediate a first fastener-jaw slot and a second fastener-jaw slot for holding relatively narrow hinges firmly.
Figure 9:
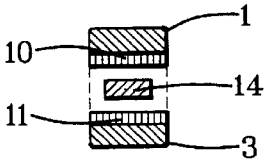
FIG. 9 is a cross-sectional view through cross-sectional line 2A–2A' in FIG. 2 for illustrating relatively wide hinges of a T-SNAP® intermediate a first fastener-hinge notch and a second fastener-hinge notch that extend from-side-to-side of jaws.

Referring to FIGS. 7–9, a first fastener-hinge slot 41 in the first jaw 1 and a second fastener-hinge slot 42 in the second jaw 3 can be employed to contain a first sprung fastener jaw 15 and a second sprung fastener jaw 16 of a spring-opened T-joint fastener 12 such as a T-SNAP® fastener. The first fastener-hinge slot 41 and the second fastener-hinge slot 42 are parallel to the first jaw 1 and the second jaw 3 respectively. Consequently, they are perpendicular to the first grip bay 8 and the second grip bay 9. As a result, T-SNAPS® are held securely while being positioned and T-clamped onto targeted wires 19. A first fastener-hinge notch 10 and a second fastener-hinge notch 11 are extended laterally from-side-to-side of the first jaw 1 and the second jaw 3 respectively to accommodate relatively wide spring-expansion joints 14.

Figure 10:
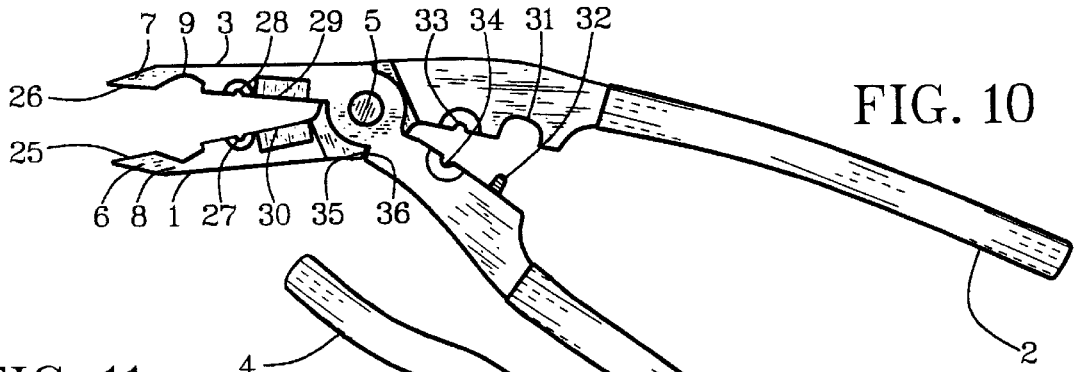
FIG. 10 is a right-side elevation view of an embodiment having a preferred mix of a plurality of wire processors on both sides of a pliers axle and positioned for bottom-surface use.

Referring to FIG. 10, a plurality of wire processors can be positioned on either or both sides of the pliers axle 5 as depicted. Included differently than explained in relation to FIGS. 1–6 can be such wire processors as a large-wire stripper having a large first wire-stripper bay 33 in a first handle 2 and a large second wire-stripper bay 34 in a second handle 4. Optionally for first-class leverage, the first wire-cutting blade 29 and the second wire-cutting blade 30 can be positioned proximate a jaw side of the pliers axle 5 for cutting relatively thick or tough wires.

Figure 11:
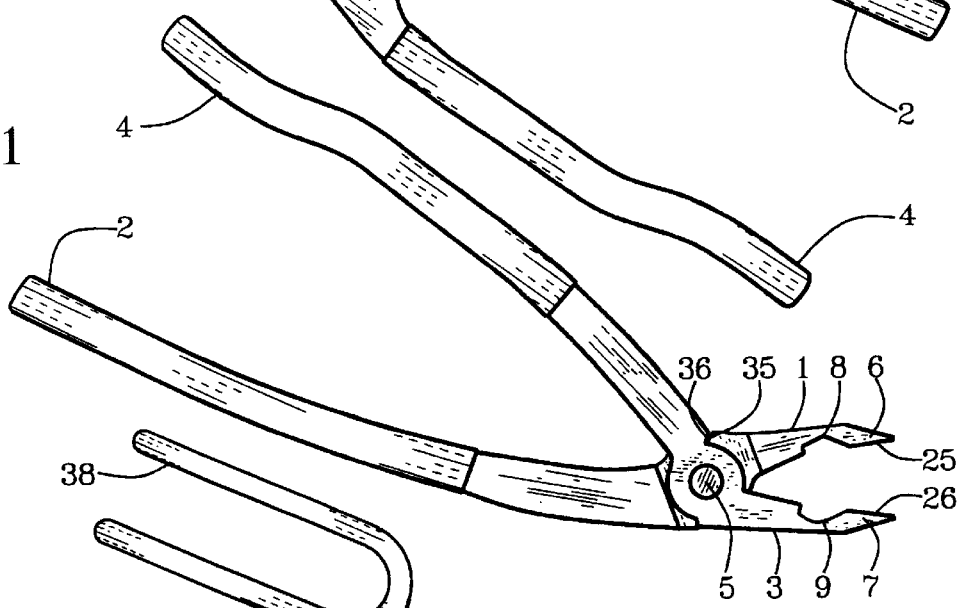
FIG. 11 is a right-side elevation view of an embodiment having short jaws, limited opening and precise grip bays for particular T-joint fasteners.

Referring to FIG. 11, first jaws 1 and second jaws 3 that are relatively short with either no wire-processor tools or with only a first wire-grasping surface 25 and a second wire-grasping surface 26 are preferable in an embodiment of this electrical T-fastener pliers for some use conditions. The first grip bay 8 and the second grip bay 9 can be precisely matched to particular T-joint fasteners 12 and 13 described in relation to FIGS. 1–9.

Characteristic of electrical T-fastener pliers with grip bays 8 and 9 matched to spring-opened T-joint fasteners 12 is limitation of maximum opening of the first jaw 1 from the second jaw 3. This can be accomplished with a jaw buttress 35 that engages a handle buttress 36 circumferentially as depicted in FIGS. 1, 3, 10 and 11. Maximum opening of the jaws 1 and 3 is designed for accommodating spring-opened T-joint fasteners 12 that provide spring-pressured fastener containment when opened optimally.

Figure 12:
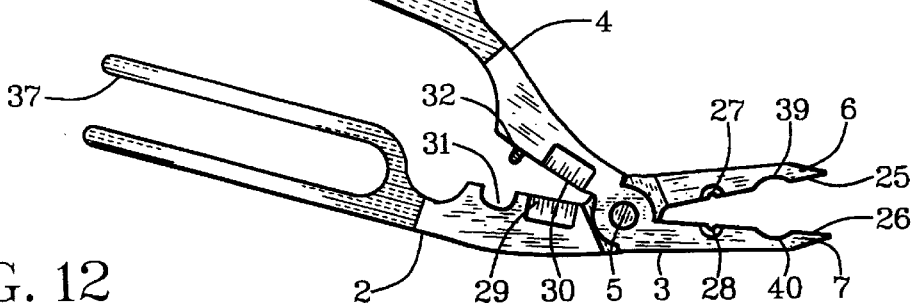
FIG. 12 is a right-side elevation view of an embodiment having sprung jaws and open-end containers for thumb and fingers in position for surface top-use.

Referring to FIG. 12, an embodiment of electrical T-fastener pliers with spring-closed jaws 1 and 3 for unsprung T-joint fasteners 13 as described in relation to FIGS. 5–6 can have a finger retainer 37 on a first handle 2 and a thumb retainer 38 on a second handle 4. This allows convenient hand opening of the jaws 1 and 3 in opposition to a containment spring 24 depicted in FIG. 5 or an internal containment spring that need not be exposed or made visible. Scissor-type or snip-type finger orifices can be provided optionally but do not provide the ease of pliers positioning made possible by open-end finger retainers 37 and open-end thumb retainers 38 depicted in FIG. 12.

Unsprung T-joint fasteners 13 and spring-opened T-joint fasteners 12 can have relatively arcuate first unsprung fastener jaws 17 and second unsprung fastener jaws 18 for which a correspondingly arcuate first grip bay 39 and a correspondingly arcuate second grip bay 40 depicted in FIGS. 5 and 12 are most appropriate.

The embodiments and variations of this electrical T-joint pliers are an electrical T-joint-pliers system in relation to spring-opened T-joint fasteners 12 and unsprung T-joint fasteners 13. The system meets a dire need for improvement in applying T-joint fasteners 12 and 13.

A new and useful electrical T-fastener pliers and method having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. An electrical T-fastener pliers comprising:

a first jaw and a first handle joined pivotally to a second jaw and a second handle with a pliers axle at a pliers fulcrum axis;

a first-jaw nose on the first jaw;

a second-jaw nose on the second jaw;

the first-jaw nose and the second-jaw nose being a pliers nose;

a T-fastener closer intermediate the pliers nose and the pliers axle;

the T-fastener closer having a first grip bay extended from an inside edge of the first jaw intermediate the first-jaw nose and the pliers axle;

the T-fastener closer having a second grip bay extended from an inside edge of the second jaw intermediate the second-jaw nose and the pliers axle;

the first grip bay and the second grip bay being at designedly equal distances from the pliers axle;

the first grip bay being sized and shaped to receive a first side of a T-joint fastener;

the second grip bay being sized and shaped to receive a second side of the T-joint fastener;

a containment spring with jaw-closed-mode expansion pressure oppositely disposed and directed towards a jaw-closed mode of the first jaw and the second jaw in correlation to opening of the first handle and the second handle as a spring-pressure holder for holding the T-joint fastener intermediate the first grip bay and the second grip bay;

the jaws having an opening gap sufficiently wide to allow a T-joint fastener to fit intermediate the first grip bay in the first jaw and the second grip bay in the second jaw;

the first grip bay being sized and shaped to receive the first fastener jaw of a select size range and type of the T-joint fasteners;

the second grip bay being sized and shaped to receive the second fastener jaw of the select size range and type of the T-joint fasteners;

the size range and type of the T-joint fasteners including a spring-opened T-joint fastener having and expansion spring intermediate fastener jaws that are expanded to a maximum open mode by the expansion spring;

force of the expansion spring being transmitted by the fastener jaws against grip bays in jaws of the electrical T-fastener pliers being the spring-pressured holder of the T-joint fastener;

the first jaw and the second jaw having sufficient ease of opening in opposition to the jaw-closed-mode expansion pressure of the containment spring for expansion pressure of the spring-opened T-joint fastener to hold open the first jaw and the second jaw with the spring-opened T-joint fastener held snugly intermediate the first jaw and the second jaw;

the spring-opened T-joint fastener being a T-SNAP® fastener;

a first fastener-hinge slot in an inside wall of the first jaw;

the first fastener-hinge slot being extended perpendicularly from the fist grip bay in a direction towards the pliers axle;

a second fastener-hinge slot in an inside wall of the second jaw; and the second fastener-hinge slot being extended perpendicularly from the second grip bay in a direction towards the pliers axle.

2. An electrical T-fastener pliers comprising:

a first jaw and a first handle joined pivotally to a second jaw and a second handle with a pliers axle at a pliers fulcrum axis;

a first-jaw nose on the first jaw;

a second-jaw nose on the second jaw;

the first-jaw nose and the second-jaw nose being a pliers nose;

a T-fastener closer intermediate the pliers nose and the pliers axle;

the T-fastener closer having a first grip bay extended from an inside edge of the first jaw intermediate the first-jaw nose and the pliers axle;

the T-fastener closer having a second grip bay extended from an inside edge of the second jaw intermediate the second-jaw nose and the pliers axle;

the first grip bay and the second grip bay being at designedly equal distances from the pliers axle;

the first grip bay being sized and shaped to receive a first side of a T-joint fastener;

the second grip bay being sized and shaped to receive a second side of the T-joint fastener;

a containment spring with jaw-closed-mode expansion pressure oppositely disposed and directed towards a jaw-closed mode of the first jaw and the second jaw in correlation to opening of the first handle and the second handle as a spring-pressure holder for holding the T-joint fastener intermediate the first grip bay and the second grip bay;

a first fastener-hinge slot in an inside wall of the first jaw;

the first fastener-hinge slot being extended perpendicularly from the fist grip bay in a direction towards the pliers axle;

a second fastener-hinge slot in an inside wall of the second jaw; and the second fastener-hinge slot being extended perpendicularly from the second grip bay in a direction towards the pliers axle.

3. An electrical T-fastener pliers comprising:

a first jaw and a first handle joined pivotally to a second jaw and a second handle with a pliers axle at a pliers fulcrum axis;

a first-jaw nose on the first jaw;

a second-jaw nose on the second jaw;

the first-jaw nose and the second-jaw nose being a pliers nose;

a T-fastener closer intermediate the pliers nose and the pliers axle;

the T-fastener closer having a first grip bay extended from an inside edge of the first jaw intermediate the first-jaw nose and the pliers axle;

the T-fastener closer having a second grip bay extended from an inside edge of the second jaw intermediate the second-jaw nose and the pliers axle;

the first grip bay and the second grip bay being at designedly equal distances from the pliers axle;

the first grip bay being sized and shaped to receive a first side of a T-joint fastener;

the second grip bay being sized and shaped to receive a second side of the T-joint fastener;

a containment spring with jaw-closed-mode expansion pressure oppositely disposed and directed towards a jaw-closed mode of the first jaw and the second jaw in correlation to opening of the first handle and the second handle as a spring-pressure holder for holding the T-joint fastener intermediate the first grip bay and the second grip bay;

the jaws having an opening gap sufficiently wide to allow a T-joint fastener to fit intermediate the first grip bay in the first jaw and the second grip bay in the second jaw;

the first grip bay being sized and shaped to receive the first fastener jaw of a select size range and type of the T-joint fasteners;

the second grip bay being sized and shaped to receive the second fastener jaw of the select size range and type of the T-joint fasteners;

the size range and type of the T-joint fasteners including a spring-opened T-joint fastener having and expansion spring intermediate fastener jaws that are expanded to a maximum open mode by the expansion spring;

force of the expansion spring being transmitted by the fastener jaws against grip bays in jaws of the electrical T-fastener pliers being the spring-pressured holder of the T-joint fastener;

the first jaw and the second jaw having sufficient ease of opening in opposition to the jaw-closed-mode expansion pressure of the containment spring for expansion pressure of the spring-opened T-joint fastener to hold open the first jaw and the second jaw with the spring-opened T-joint fastener held snugly intermediate the first jaw and the second jaw;

the spring-opened T-joint fastener being a T-SNAP® fastener;

a first fastener-hinge notch in an inside wall of the first jaw;

the first fastener-hinge notch being extended laterally from-side-to-side of the first grip bay and linearly in a direction towards the pliers axle;

a second fastener-hinge notch in an inside wall of the second jaw; and the second fastener-hinge notch being extended laterally from-side-to-side of the second grip bay and linearly in a direction towards the pliers axle.

4. An electrical T-fastener pliers comprising:

a first jaw and a first handle joined pivotally to a second jaw and a second handle with a pliers axle at a pliers fulcrum axis;

a first-jaw nose on the first jaw;

a second-jaw nose on the second jaw;

the first-jaw nose and the second-jaw nose being a pliers nose;

a T-fastener closer intermediate the pliers nose and the pliers axle;

the T-fastener closer having a first grip bay extended from an inside edge of the first jaw intermediate the first-jaw nose and the pliers axle;

the T-fastener closer having a second grip bay extended from an inside edge of the second jaw intermediate the second-jaw nose and the pliers axle;

the first grip bay and the second grip bay being at designedly equal distances from the pliers axle;

the first grip bay being sized and shaped to receive a first side of a T-joint fastener;

the second grip bay being sized and shaped to receive a second side of the T-joint fastener;

a containment spring with jaw-closed-mode expansion pressure oppositely disposed and directed towards a jaw-closed mode of the first jaw and the second jaw in correlation to opening of the first handle and the second handle as a spring-pressure holder for holding the T-joint fastener intermediate the first grip bay and the second grip bay;

a first fastener-hinge notch in an inside wall of the first jaw;

the first fastener-hinge notch being extended laterally from-side-to-side of the first grip bay and linearly in a direction towards the pliers axle;

a second fastener-hinge notch in an inside wall of the second jaw; and the second fastener-hinge notch being extended laterally from-side-to-side of the second grip bay and linearly in a direction towards the pliers axle.

* * * * *